US011005210B2

(12) United States Patent
Tian

(10) Patent No.: US 11,005,210 B2
(45) Date of Patent: May 11, 2021

(54) ELECTRICAL CONNECTOR

(71) Applicant: Molex, LLC, Lisle, IL (US)

(72) Inventor: Yan Tian, Shanghai (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/752,700

(22) Filed: Jan. 27, 2020

(65) Prior Publication Data

US 2020/0251846 A1 Aug. 6, 2020

(30) Foreign Application Priority Data

Jan. 31, 2019 (CN) ..... 201920176573.8

(51) Int. Cl.
*H01R 13/436* (2006.01)
*H01R 13/506* (2006.01)
*H01R 13/422* (2006.01)

(52) U.S. Cl.
CPC ..... *H01R 13/4367* (2013.01); *H01R 13/4226* (2013.01); *H01R 13/4368* (2013.01); *H01R 13/506* (2013.01)

(58) Field of Classification Search
CPC ..... H01R 13/4367; H01R 13/4368
See application file for complete search history.

(56) References Cited

U.S. PATENT DOCUMENTS 5,057,042 A * 10/1991 Yamanashi ..... H01R 13/60 439/752
5,071,373 A * 12/1991 Nagasaka ..... H01R 13/436 439/752
5,123,866 A * 6/1992 Endo ..... H01R 13/4368 439/595
RE34,539 E * 2/1994 Aoyama ..... H01R 13/4368 439/752

(Continued)

FOREIGN PATENT DOCUMENTS

CN 104638417 B 7/2017
JP 60189968 U 12/1985

(Continued)

OTHER PUBLICATIONS

Decision to Grant received for JP Application No. 2020-001866 dated Feb. 2, 2021, 5 Pages. (2 Pages of English Translation and 3 Pages of Official copy).

*Primary Examiner* — Ross N Gushi

(57) ABSTRACT

An electrical connector comprises a plurality of conductive terminals, a housing and a holder. The housing has a plurality of terminal receiving grooves which extend forwardly from a rear end face of the housing and receive the terminals respectively and a locking structure which is formed to a top surface of the housing. The holder is provided to the housing, the holder has a transverse frame portion which extends in a transverse direction, a plurality of positioning arms which obliquely extend downwardly and forwardly from the frame portion and are respectively (Continued)

inserted into the grooves, and a lock plate portion which extends forwardly from a top of the frame portion to above a top surface of the housing and has elasticity, the arms respectively position the terminals along slopes inside the grooves, the lock plate portion has a lock structure which is locked with a locking structure of the housing.

11 Claims, 14 Drawing Sheets

(56) References Cited

U.S. PATENT DOCUMENTS 5,292,261 A * 3/1994 Hirano ..... H01R 13/4368 439/595
5,322,456 A * 6/1994 Yagi ..... H01R 13/4368 439/595
5,322,457 A * 6/1994 Tsuji ..... H01R 13/4368 439/595
5,458,511 A * 10/1995 Sasai ..... H01R 13/4368 403/326
5,569,055 A * 10/1996 Yamanashi ..... H01R 13/4368 439/595
5,611,712 A * 3/1997 Morishita ..... H01R 13/4367 439/752
5,890,935 A * 4/1999 Pill ..... H01R 13/4368 439/752
6,290,539 B1 * 9/2001 Wilber ..... H01R 13/4223 439/595
10,381,775 B2 * 8/2019 Zheng ..... H01R 13/6272
10,644,443 B2 * 5/2020 Zheng ..... H01R 13/428

FOREIGN PATENT DOCUMENTS

JP H0192773 U 6/1989
JP H1167318 A 3/1999
JP 2000200649 A 7/2000
JP 2001291547 A 10/2001
JP 2016195080 A 11/2016
TW D187629 S 1/2018
TW D188868 S 3/2018

* cited by examiner

ELECTRICAL CONNECTOR

RELATED APPLICATIONS

This application claims priority to Chinese Application No. 201920176573.8 filed on Jan. 31, 2019, which is incorporated herein by reference in its entirety.

TECHNICAL FIELD

The present disclosure relates to an electrical connector, especially relates to an electrical connector with a holder.

BACKGROUND

U.S. Pat. No. 5,458,511 (hereinafter referred to as a first prior art) discloses a terminal retaining portion formed onto a metal terminal, the terminal retainer protrudes upwardly and is provided to a rear side of a contacting portion. An engagement hole into which an engagement projection is may be inserted formed to a lower surface of the contacting portion. A front end of a retaining piece of the retainer abuts a rear edge of an upper portion of terminal retaining portion. Engagement pieces are respectively formed to opposite ends of a body of the retainer, and project in the same direction as the direction of projection of the retaining pieces and guide pieces. Two engagement holes for contacting with a projection on the side surface of the housing are formed in the engagement pieces, in which one engagement hole makes the retainer held in a provisionally-locked position, and the other engagement hole makes the retainer held in a completely-locked position.

Chinese invention patent application issuance publication No. CN104638417B (hereinafter referred to as a second prior art) discloses a rear locking portion (which is a protruding portion integrally formed to extend upwardly) formed to an upper plate of a contacting cylinder portion and positioned behind a front locking portion. When a holder is mounted to a second housing, a front end portion of a locking arm of the holder locks the rear locking portion, so as to prevent a second terminal mounted to the second housing from being pulled out from the rear. When the holder is mounted to the second housing, an upper guiding rib and a lower guiding rib guide upper and lower edges of a sliding plate portion of the holder. A lock protruding portion locks a lock recessed portion which is formed to the sliding plate portion.

However, the first prior art (using the engagement pieces) and the second prior art (using the sliding plate portion) both use an manner of moving in a straight line and performing engagement, such a manner is adapted to a case that an enough gap exists between a conductive wire and the plastic housing, if the gap is not large enough, a retainer (or a holder) is not easy to be inserted. Because a diameter of the conductive wire used in the first prior art and the second prior art is relatively small, there exists an enough gap between the conductive wire and the plastic housing for the retainer (or the holder) to be inserted, however, when the diameter of the conductive wire increases (for example, the diameter is 16 AWG), the gap between the conductive wire and the plastic housing is easy to be not large enough, leading to the retainer (or the holder) being not easily to be inserted. Moreover, the engagement piece of the first prior art and the sliding plate portion of the second prior art increase the size of the transverse width of the connector, which is beneficial for miniaturization. And when it is applied to a case that the number of the conductive terminals is large, the holding force of the conductive terminal positioned in the middle will be relatively small.

SUMMARY

Therefore, an object of the present disclosure is to provide an electrical connector which can improve at least one of the shortcomings of the prior arts.

Accordingly, in some embodiments, an electrical connector of the present disclosure comprises a plurality of conductive terminals, a housing and a holder. Each conductive terminal connects a cable mechanically, the cable comprises an insulating portion and a conductive wire portion, the insulating portion has a front end face, the conductive wire portion extends from the front end face and electrically connects the conductive terminal. The housing has a plurality of terminal receiving grooves which extend forwardly from a rear end face of the housing and receive the conductive terminals respectively and a locking structure which is formed to a top surface of the housing, each terminal receiving groove has an upper inner wall face, a lower inner wall face, a slope which is formed to the upper inner wall face and obliquely extends downwardly and forwardly from a position adjacent to the rear end face of the housing and a receiving recessed portion which is formed to the lower inner wall face and receives the corresponding conductive terminal. The holder is provided to the housing, the holder has a transverse frame portion which extends in a transverse direction, a plurality of positioning arms which obliquely extend downwardly and forwardly from the transverse frame portion and are respectively inserted into the terminal receiving grooves and a lock plate portion which extends forwardly from a top of the transverse frame portion to above a top surface of the housing and has elasticity. Each positioning arm has a first oblique segment which is close to the transverse frame portion and a second oblique segment which is connected to the first oblique segment and is away from the transverse frame portion, an angle of obliqueness of the second oblique segment is larger than an angle of obliqueness of the first oblique segment, the corresponding slope guides the positioning arm to make a front end of the second oblique segment position the corresponding conductive terminal, and the front end face of the insulating portion of the corresponding cable is positioned at the first oblique segment, the lock plate portion is formed with a lock structure which is locked with the locking structure of the housing.

In some embodiments, the terminal receiving grooves are arranged side by side along a direction, the transverse frame portion extends along the direction.

In some embodiments, the terminal receiving grooves are a plurality of first terminal receiving grooves, the locking structure is a first locking structure, the housing further has a plurality of second terminal receiving grooves which are arranged side by side along the direction, extend forwardly from the rear end face of the housing and are positioned below the first terminal receiving grooves and a second locking structure which is formed to a bottom surface of the housing, the first terminal receiving grooves receive one part of the conductive terminals, the second terminal receiving grooves receive the other part of the conductive terminals, each second terminal receiving groove has a lower inner wall face, an upper inner wall face, a slope which is formed to the lower inner wall face and obliquely extends upwardly and forwardly from a position adjacent to the rear end face of the housing and a receiving recessed portion which is formed to the upper inner wall face and receives the corresponding conductive terminal, the electrical connector further comprises another holder, the positioning arms of the another holder respectively obliquely extend upwardly and forwardly and are inserted into the second terminal receiving grooves respectively, a lock plate portion of the another holder extends forwardly to below a bottom surface of the housing and has elasticity, the corresponding slope of the second terminal receiving groove guides the positioning arm of the another holder to make a front end of a second oblique segment of the positioning arm of the another holder position the corresponding conductive terminal, and the front end face of the insulating portion of the corresponding cable is positioned at a first oblique segment of the positioning arm of the another holder, a lock structure of the another lock plate portion is locked with the second locking structure.

In some embodiments, the lock structure of the lock plate portion and the locking structure of the housing are locked with each other in a concave convex fit.

In some embodiments, the locking structure of the housing comprises at least one latch protruding block, the lock plate portion of the holder extends transversely, and the lock structure of the lock plate portion has at least one latch hole which is latched with (engaged with) the at least one latch protruding block.

In some embodiments, the at least one latch hole is formed to penetrate the lock plate portion.

In some embodiments, the holder further has a plurality of inward recessed faces which are respectively formed to the positioning arms and respectively face the conductive terminals, the inward recessed faces respectively are arch surfaces which are recessed inwardly toward a direction away from the conductive terminals, and the inward recessed faces respectively extend from the positioning arms to the transverse frame portion.

In some embodiments, each conductive terminal is formed with a positioning protrusion, each terminal receiving groove further has a stopping face, the front end of the second oblique segment of the positioning arm pushes the positioning protrusion of the corresponding conductive terminal forwardly to the corresponding stopping face to position the corresponding conductive terminal.

In some embodiments, a front end face of the transverse frame portion of the holder abuts the rear end face of the housing.

In some embodiments, the front end faces of the insulating portions of the cables respectively abut the first oblique segments.

In some embodiments, each conductive terminal has a first clamping portion which clamps the insulating portion of the corresponding cable and a second clamping portion which clamps the conductive wire portion of the cable to be electrically connect with the conductive wire portion.

The present disclosure has following technical effects: by the lock plate portion which has elasticity, it prevents the lock plate portion from limiting an angle at which the positioning arm of the holder is inserted into the terminal receiving grooves in a process that the holder is assembled to the housing, and by the first oblique segment with a smaller angle of obliqueness and the second oblique segment with a larger angle of obliqueness, it can decrease the deformation amount of the positioning arm of the holder during inserting, so as to decrease the force needed when inserting, and can more effectively use the space of the housing to avoid increasing the size of the electrical connector. In addition, because the holder is locked to the top surface of the housing by the lock plate portion which is connected to the transverse frame portion and extends in the transverse direction, when the holder is applied to a case that the number of the conductive terminals is large, the conductive terminal positioned in the middle still can get enough holding force provided by the holder.

BRIEF DESCRIPTION OF THE DRAWINGS

Other features and effects of the present disclosure will be apparent from the embodiments with reference to figures, in which.

DETAILED DESCRIPTION OF THE PREFERRED EMBODIMENTS

Figure 1:
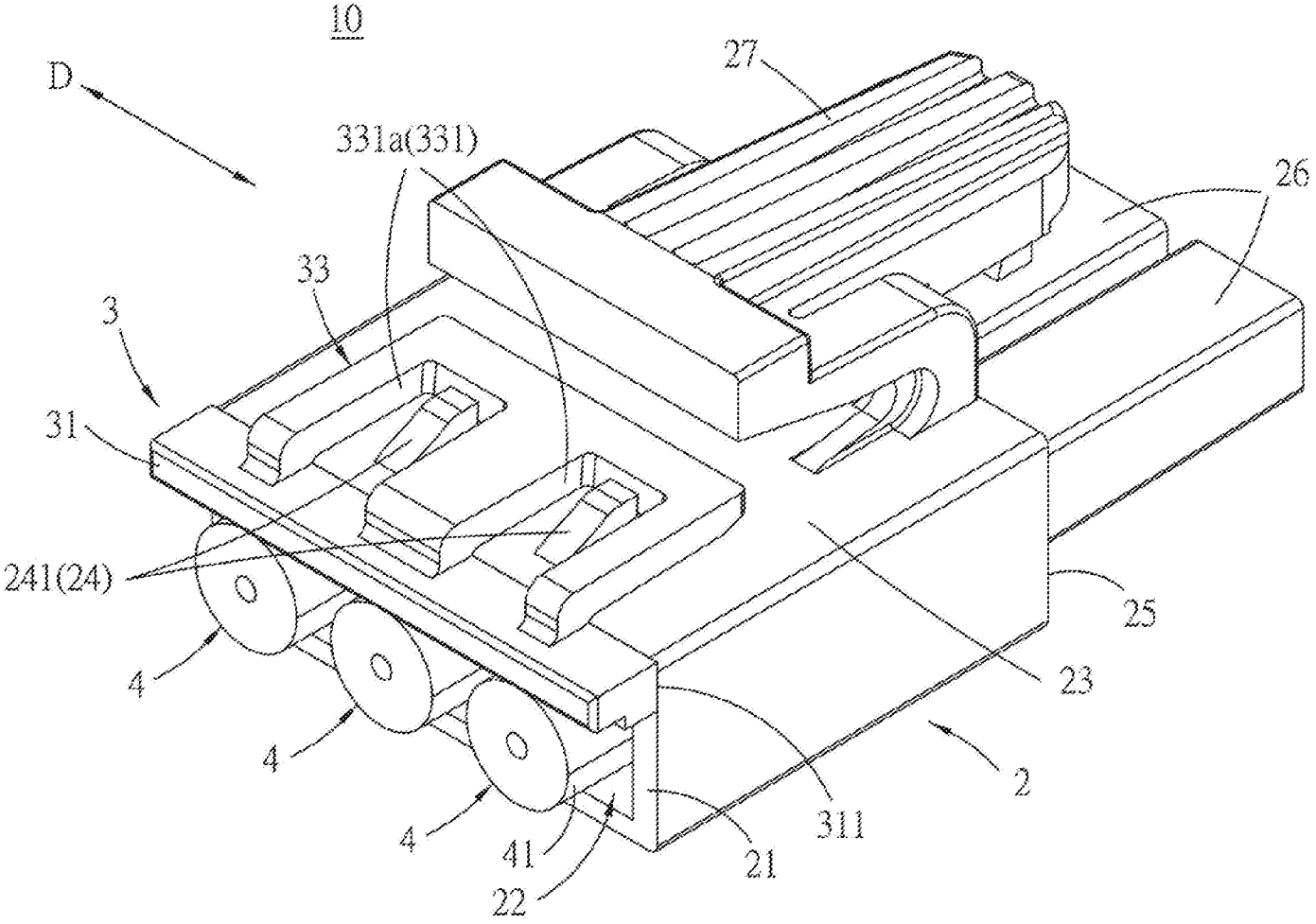
FIG. 1 is a perspective view of a first embodiment of an electrical connector of the present disclosure.

Before the present disclosure is described in detail, it should be noted that similar element is represented by the same reference numeral in the following description.

Figure 2:
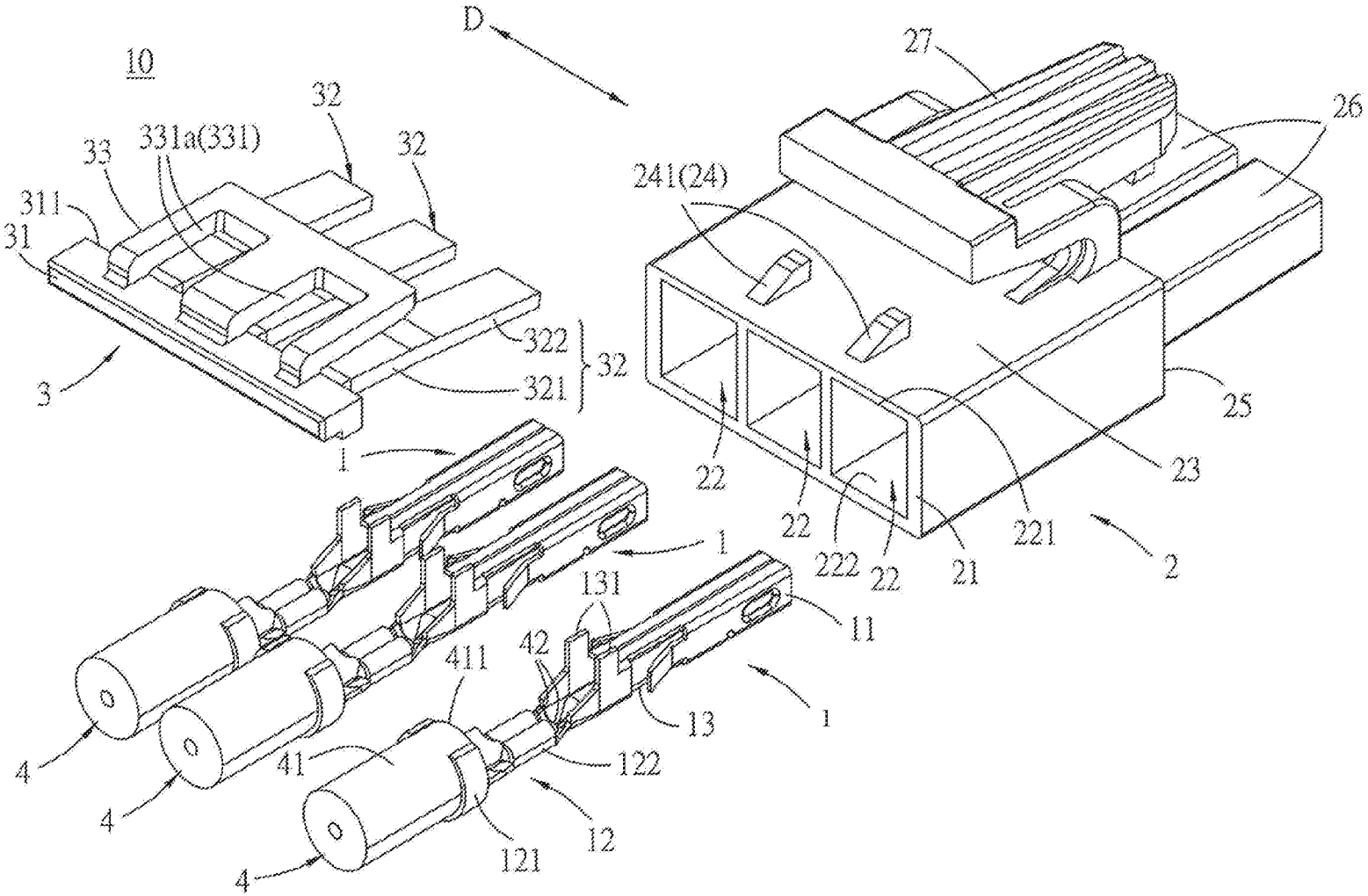
FIG. 2 is a perspective exploded view of the first embodiment.

Referring to FIG. 1 to FIG. 2, a first embodiment of an electrical connector 10 of the present disclosure comprises a plurality of conductive terminal 1, a housing 2, and a holder 3.

Each conductive terminal 1 mechanically connects a cable 4, and the cable 4 comprises an insulating portion 41 and a conductive wire portion 42, the insulating portion 41 has a front end face 411, the conductive wire portion 42 extends out of the front end face 411 and is electrically connected to the conductive terminal 1. And in the first embodiment, each conductive terminal 1 has a mating segment 11 positioned on a front side, a tail segment 12 positioned on a rear side, and a connecting segment 13 connected between the mating segment 11 and the tail segment 12. The tail segment 12 has a first clamping portion 121 which clamps the insulating portion 41 of the corresponding cable 4 and a second clamping portion 122 which clamps the conductive wire portion 42 of the cable 4 to be electrically connected with the conductive wire portion 42.

Figure 3:
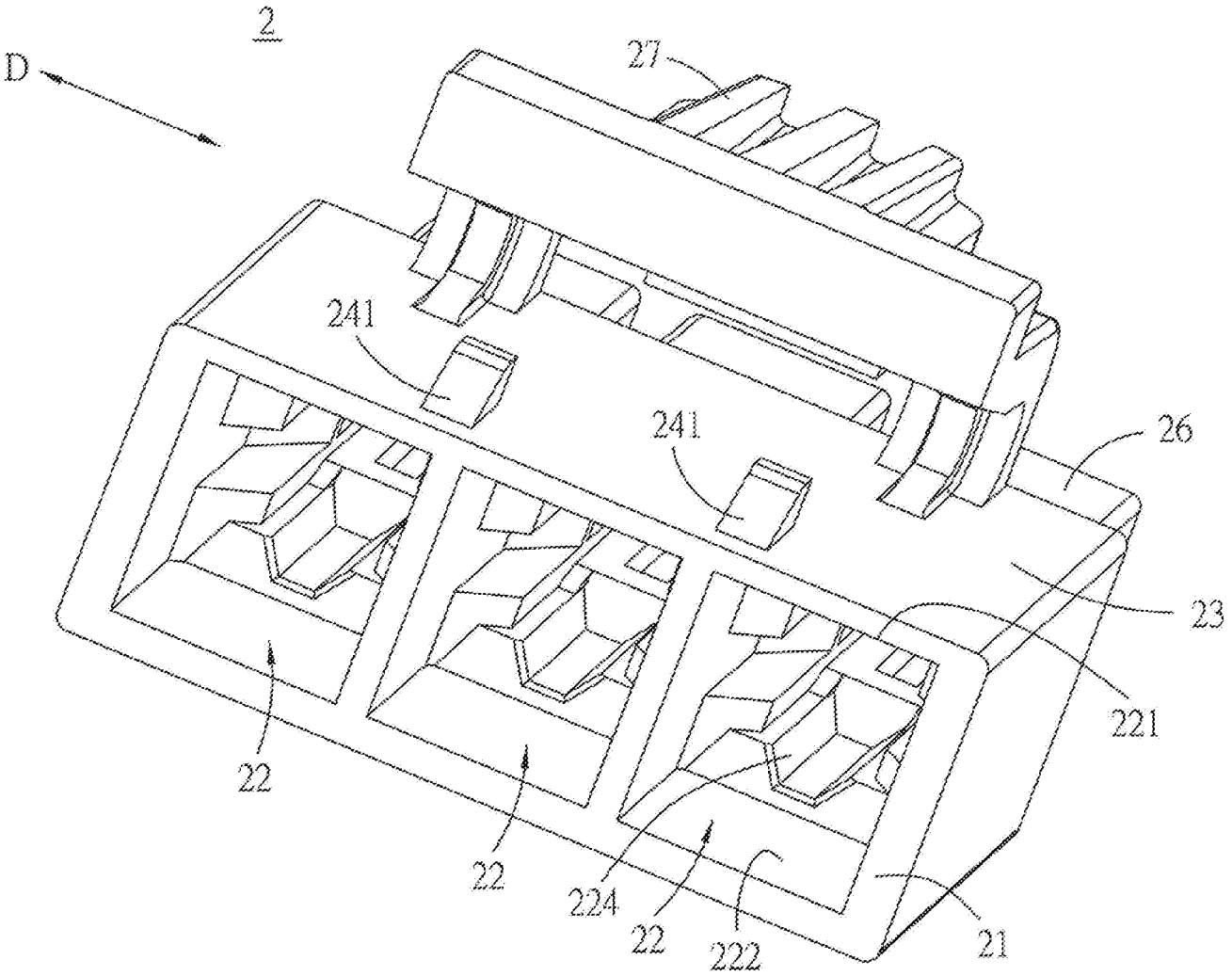
FIG. 3 is a perspective view of a housing of the first embodiment.
Figure 4:
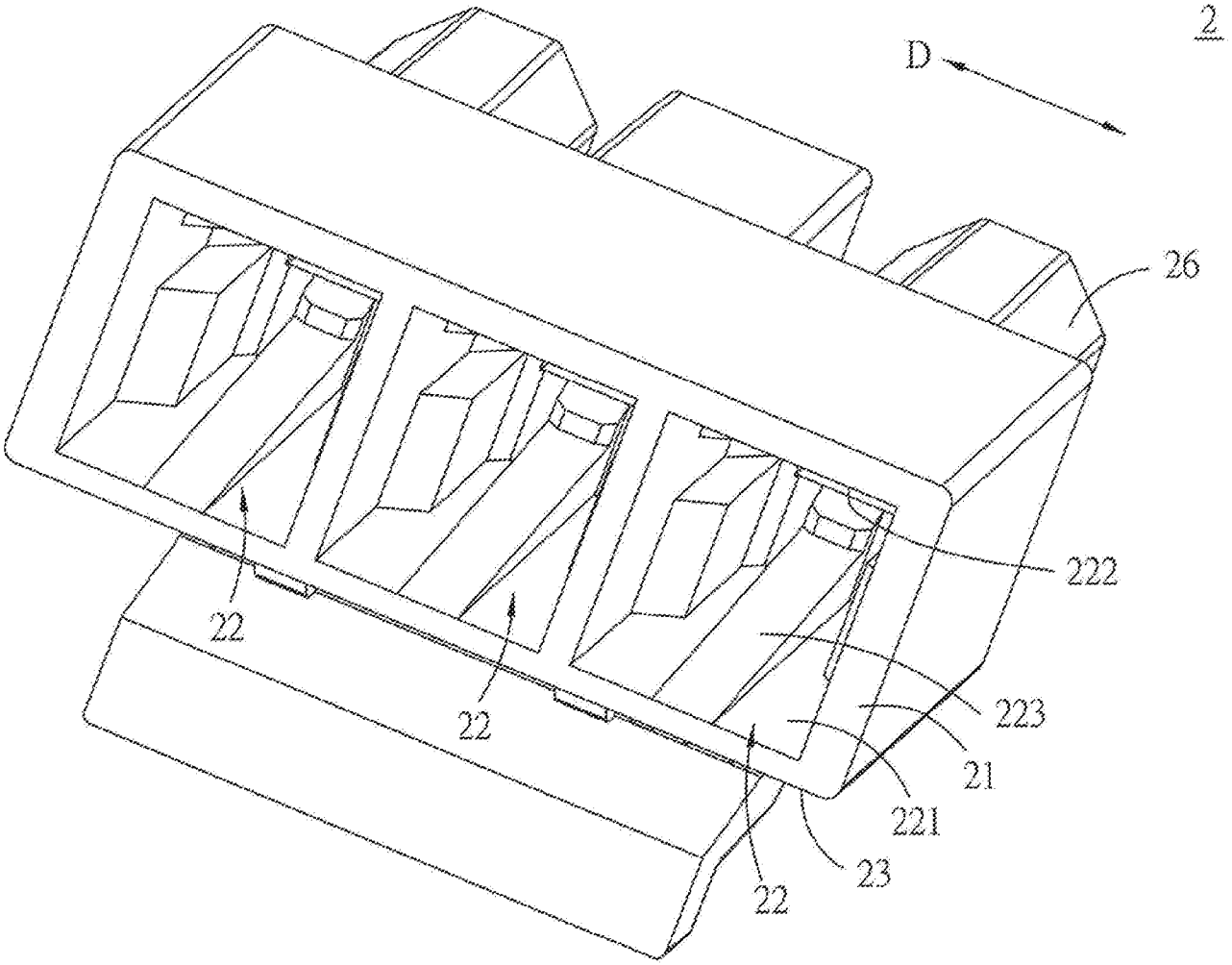
FIG. 4 is a perspective view of FIG. 3 from a different angle.
Figure 5:
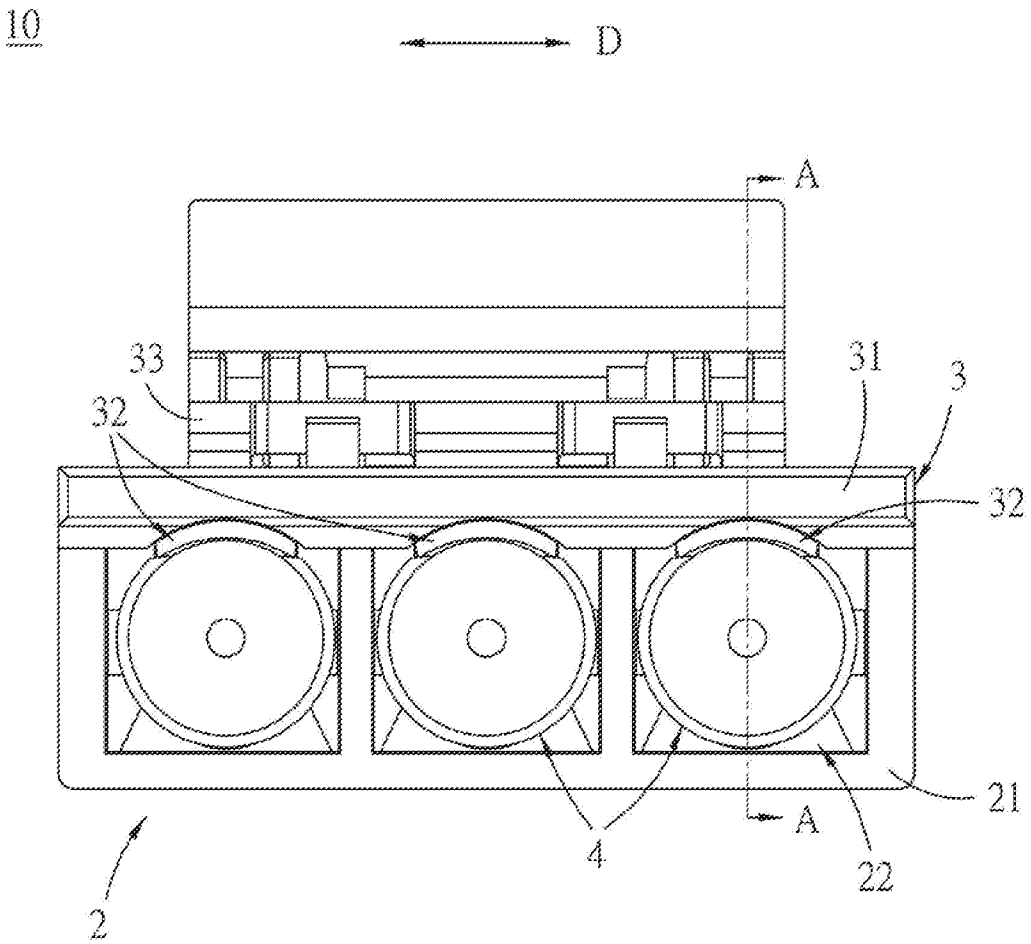
FIG. 5 is a rear view of the first embodiment.
Figure 6:
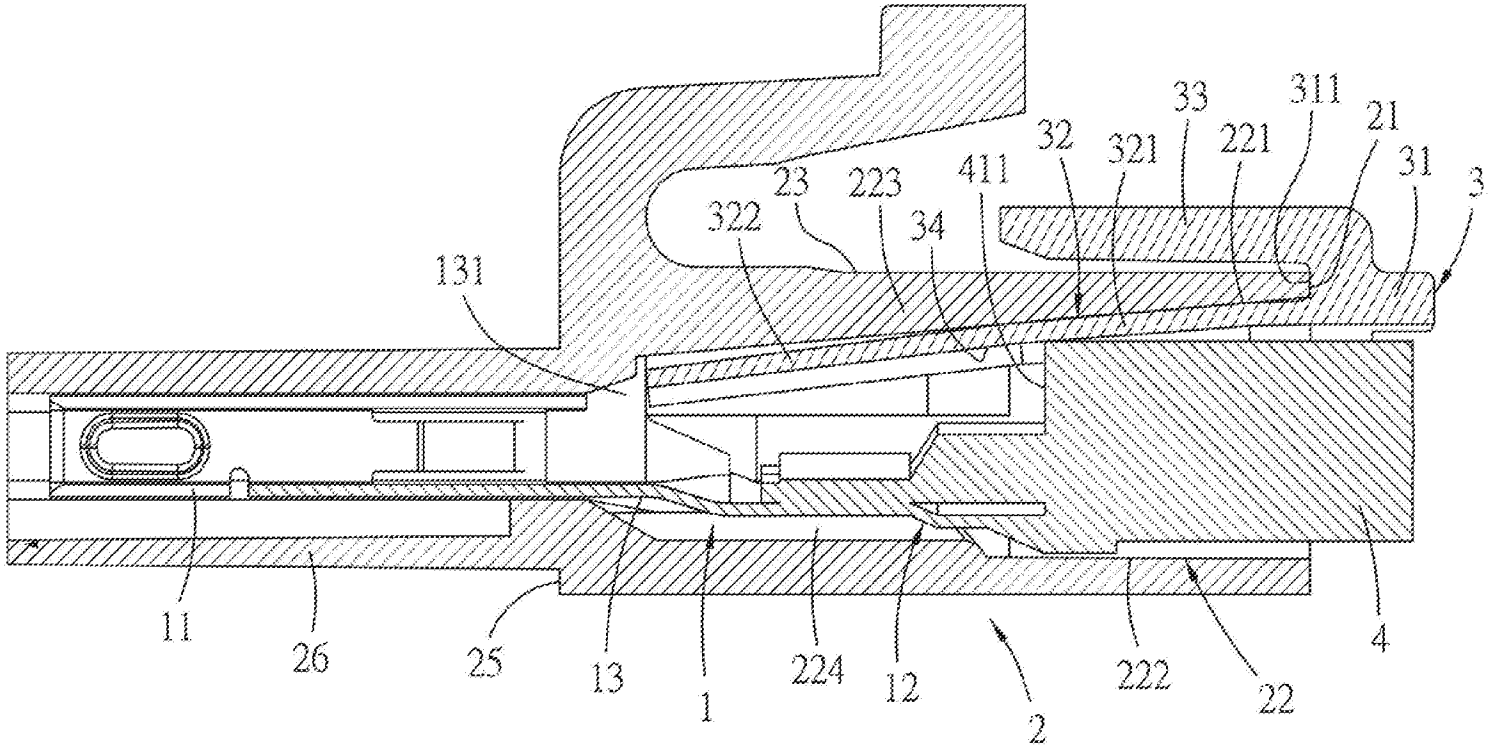
FIG. 6 is a cross-sectional view taken along a line A-A of FIG. 5.
Figure 7:
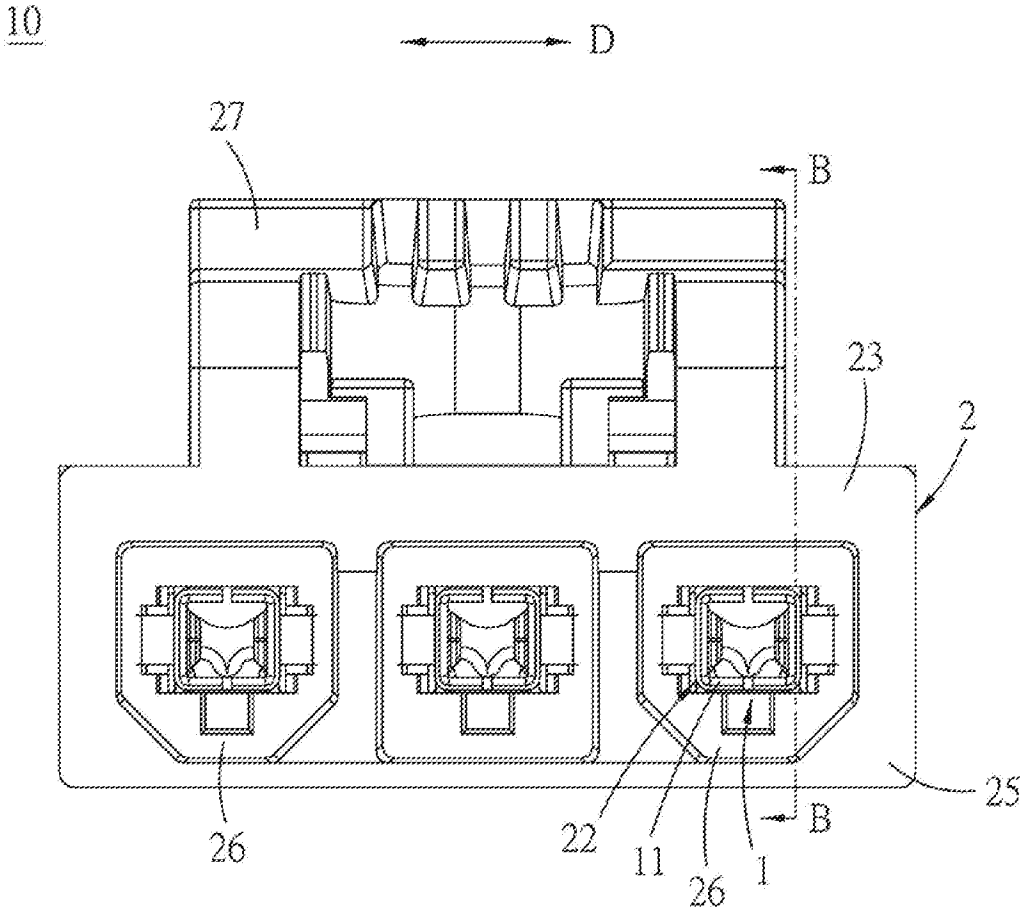
FIG. 7 is a front view of the first embodiment.
Figure 8:
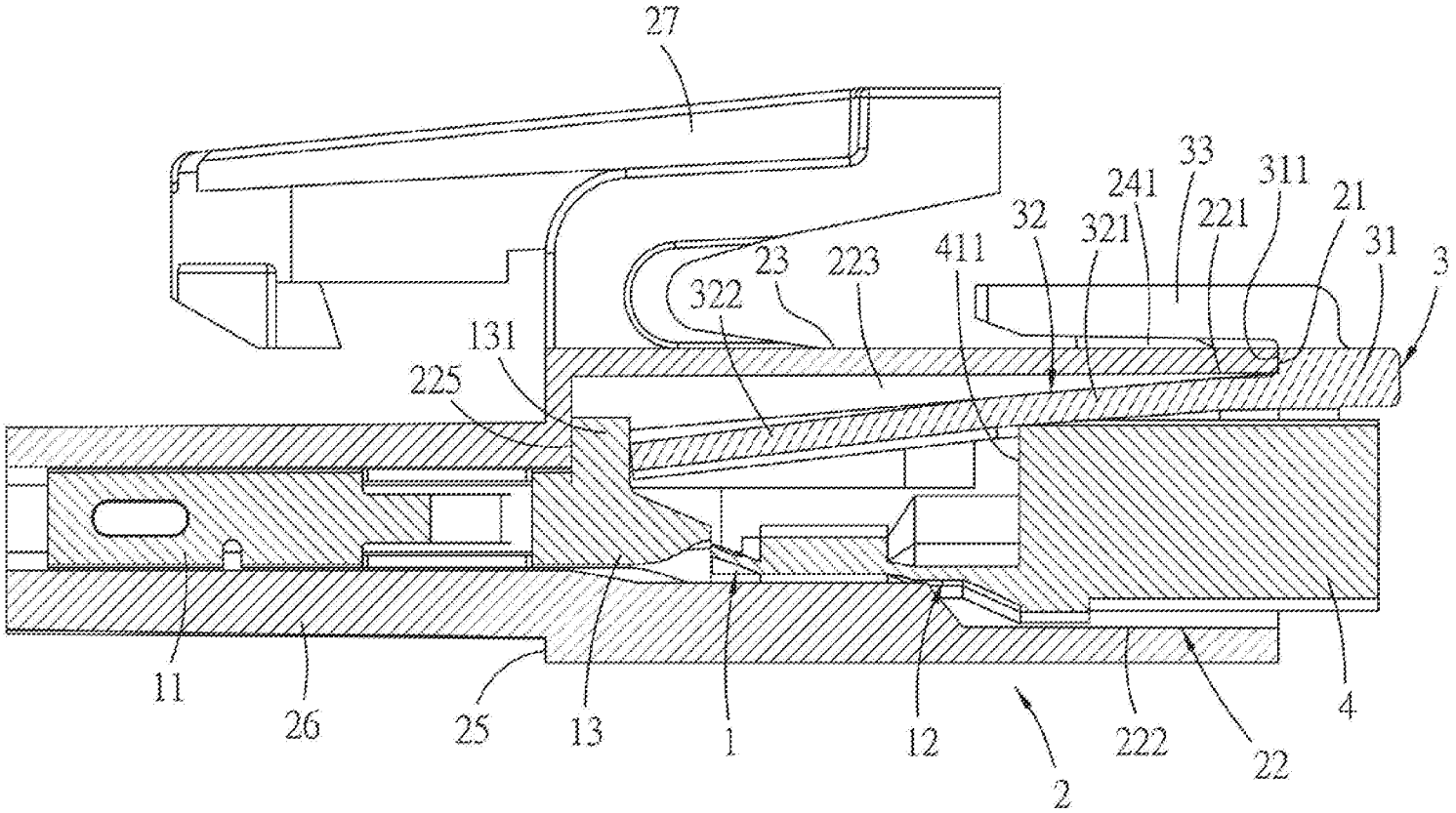
FIG. 8 is a cross-sectional view taken along a line B-B of FIG. 7.

In combination with referring to FIG. 1 and FIG. 3 to FIG. 4, the housing 2 has a plurality of terminal receiving grooves 22 which extend forwardly from a rear end face of the housing 2 and receive the conductive terminals 1 and a locking structure 24 which is formed to a top surface 23 of the housing 2, a material of the housing 2 for example may be a plastic. Each terminal receiving groove 22 has an upper inner wall face 221, a lower inner wall face 222, a slope 223 which is formed to the upper inner wall face 221 and obliquely extends forwardly and downwardly from a position adjacent to a rear end face 21 of the housing 2, and a receiving recessed portion 224 which is formed to the lower inner wall face 222 and receives the corresponding conductive terminal 1. Specifically, the housing 2 further has a plurality of mating columns 26 which extend forwardly from a front end face 25 of the housing 2 and respectively correspond to the terminal receiving grooves 22, the terminal receiving groove 22 extends forwardly from the rear end face 21 of the housing 2 to penetrate the mating column 26, and allows the mating segment 11 of the conductive terminal 1 positioned on the front side to be exposed to an opening of the terminal receiving groove 22 positioned on a front end of the mating column 26. Moreover, in the first embodiment, the housing 2 further has a latching structure 27 which extends from the top surface 23 of the housing 2 and is used to latch with a mating connector (not illustrated) capable of mating with the electrical connector 10.

Figure 9:
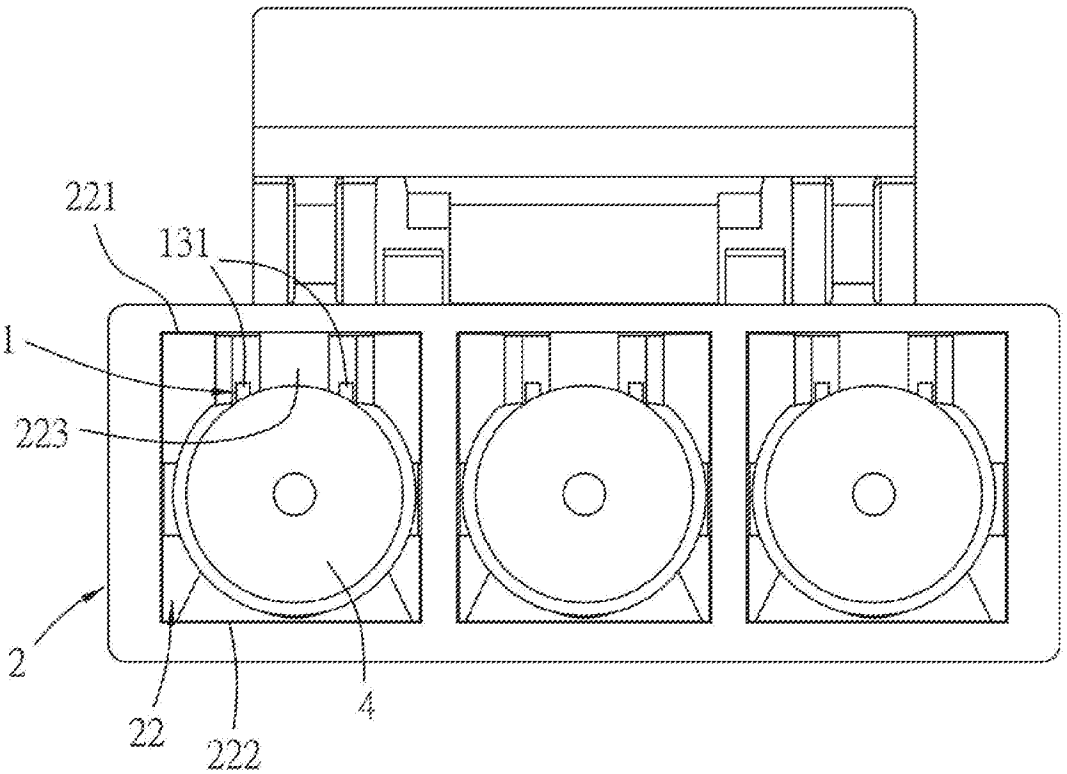
FIG. 9 is a rear view of the first embodiment, with a holder of the first embodiment omitted.
Figure 10:
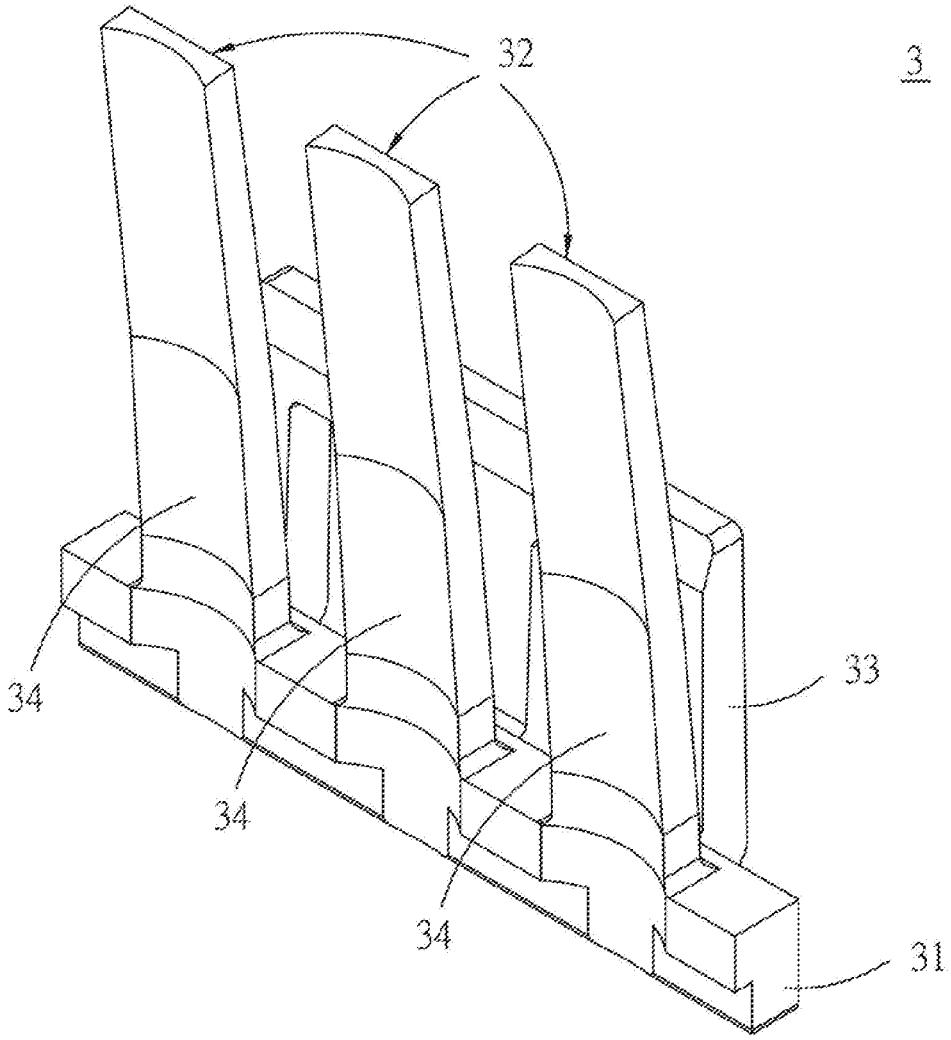
FIG. 10 is a perspective view illustrating a bottom structure of a holder of the first embodiment.
Figure 11:
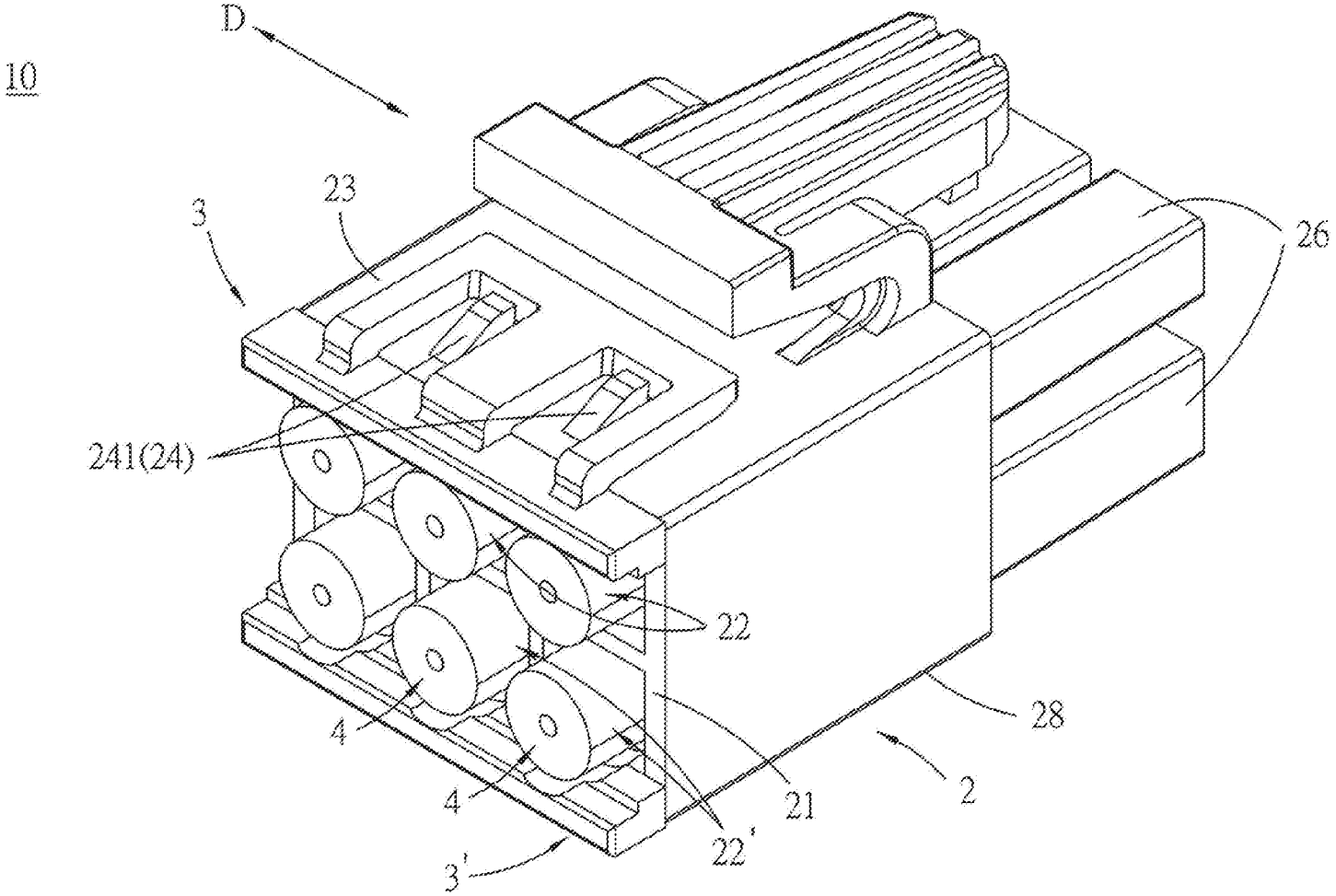
FIG. 11 is a perspective view of a second embodiment of the electrical connector of the present disclosure.
Figure 12:
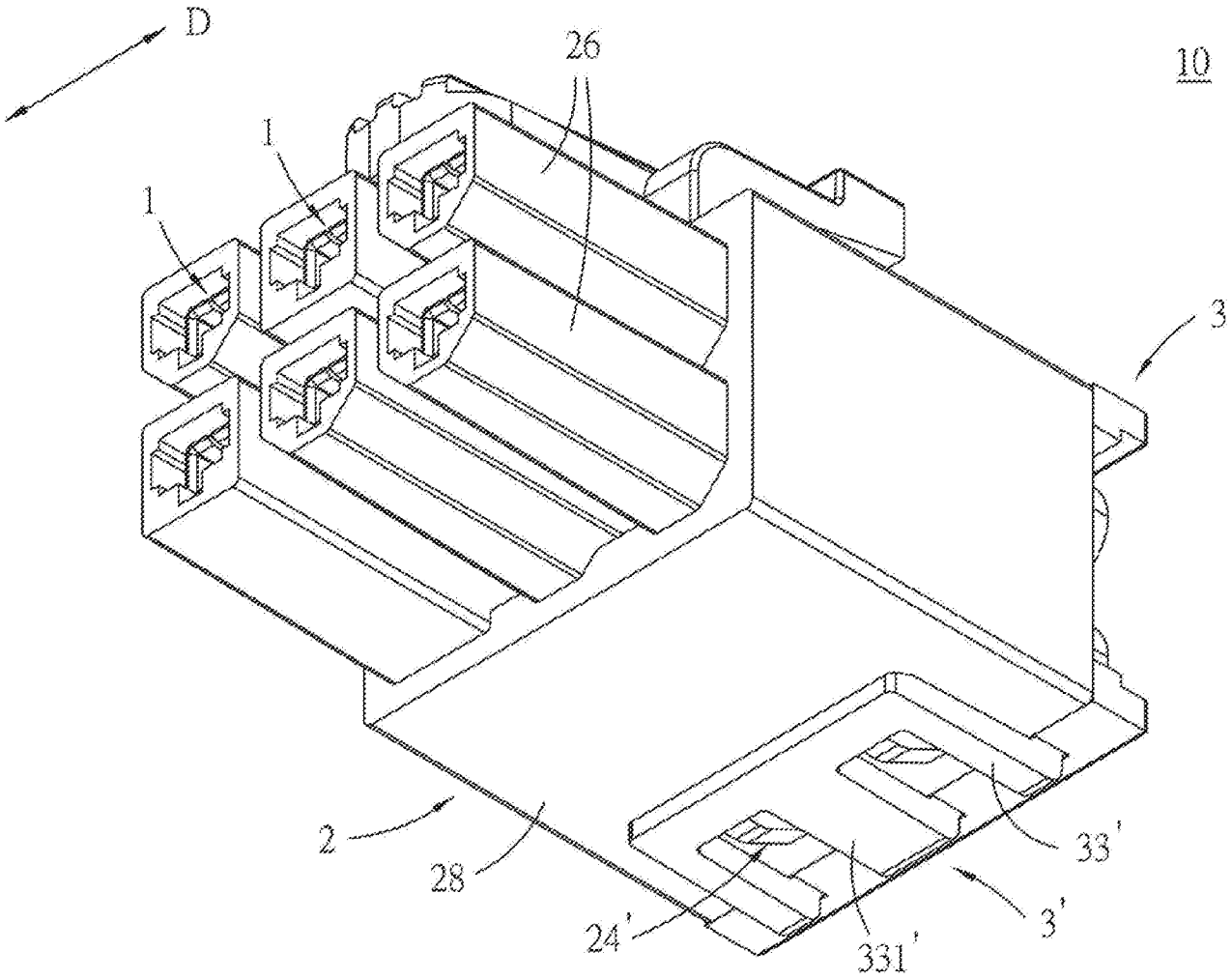
FIG. 12 is a perspective view of FIG. 11 from a different angle.
Figure 13:
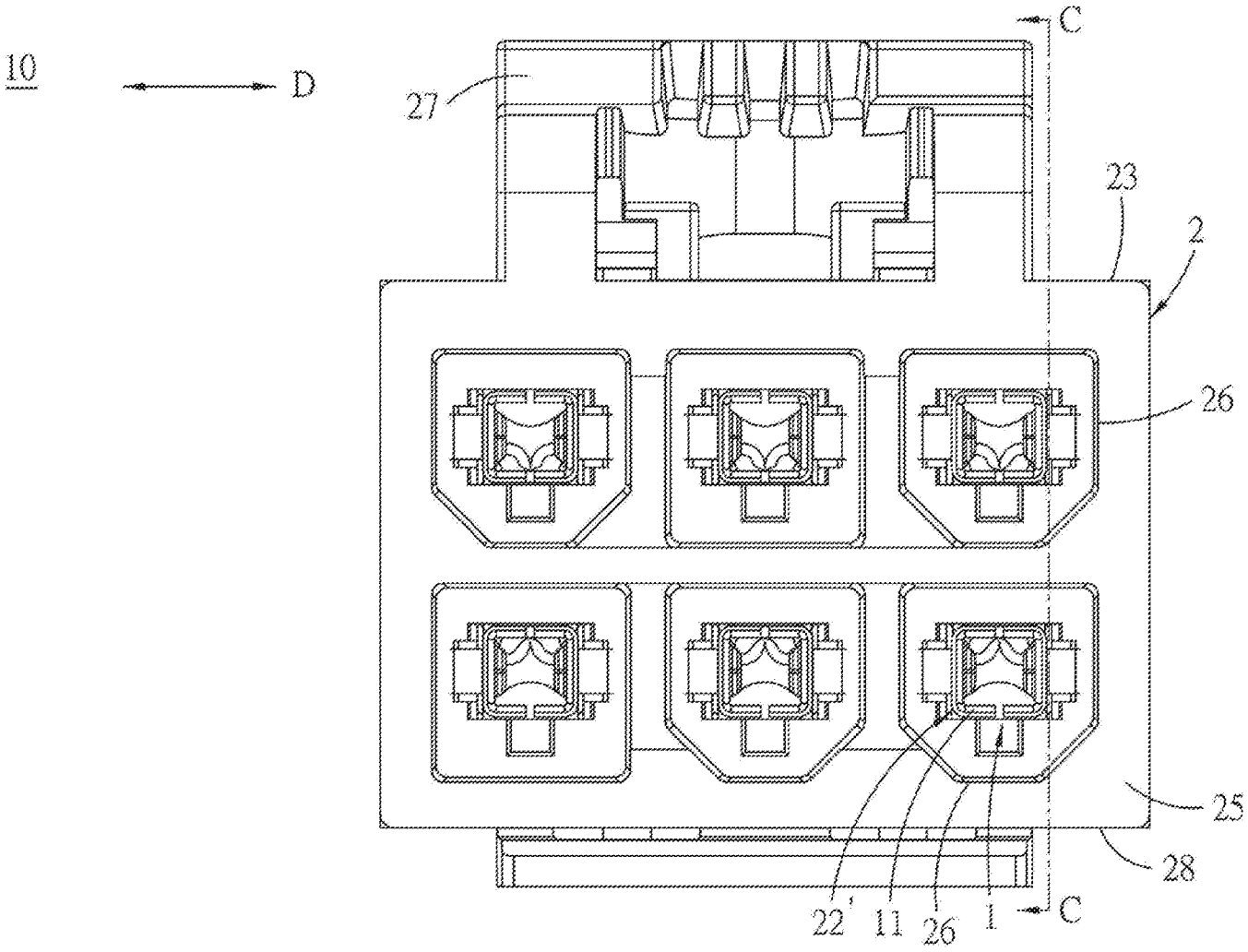
FIG. 13 is a front view of the second embodiment.
Figure 14:
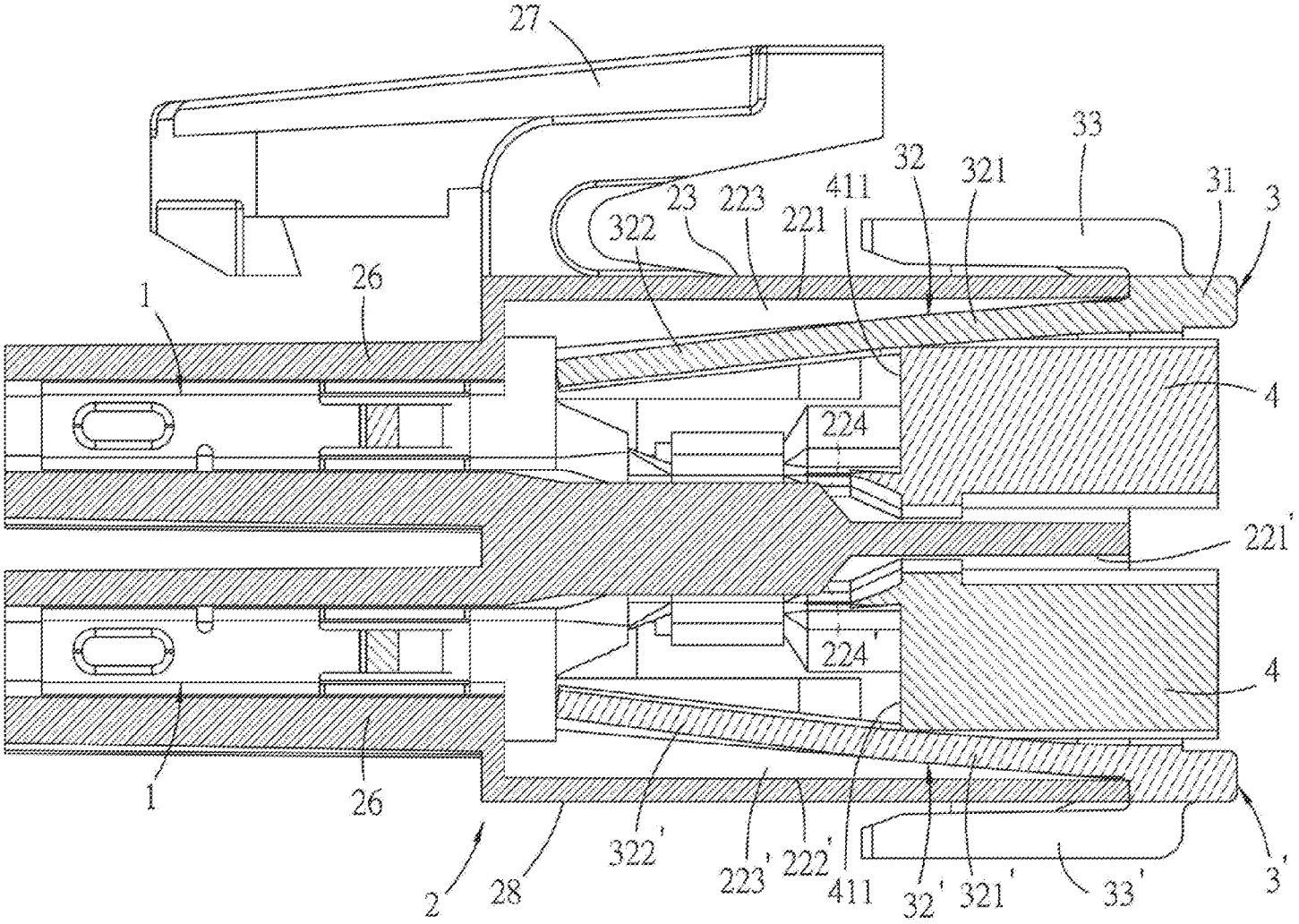
FIG. 14 is a cross-sectional view taken along a line C-C of FIG. 13.

Referring to FIG. 2, FIG. 5 to FIG. 8, the holder 3 is provided to the housing 2, the holder 3 has a transverse frame portion 31 which extends in a transverse direction, a plurality of positioning arm 32 which obliquely extend downwardly and forwardly from the transverse frame portion 31 and are respectively inserted into the terminal receiving grooves 22, and a lock plate portion 33 which extends forwardly from a top of the transverse frame portion 31 to above the top surface 23 of the housing 2 and has elasticity, a material of the holder 3 for example may be plastic but is not limited thereto. In the first embodiment, the terminal receiving grooves 22 are arranged side by side along a width direction D of the housing 2, and the transverse frame portion 31 extends along the width direction D of the housing 2, and is not limited thereto. Each positioning arm 32 has a first oblique segment 321 which is close to the transverse frame portion 31 and a second oblique segment 322 which is connected to the first oblique segment 321 and is away from the transverse frame portion 31, an oblique angle of obliqueness of the second oblique segment 322 is larger than an angle of obliqueness of the first oblique segment 321, the corresponding slope 223 guides the positioning arm 32 to make a front end of the second oblique segment 322 position the corresponding conductive terminal 1, and the front end face 411 of the insulating portion 4 of the corresponding cable 4 is positioned at the first oblique segment 321, the angle of obliqueness of the first oblique segment 321 for example may be matched with the corresponding slope 223, and is not limited thereto. In combination with referring to FIG. 2, FIG. 8 and FIG. 9, in the first embodiment, the connecting segment 13 of each conductive terminal 1 is formed with two positioning protrusions 131 which are spaced apart from each other transversely, extend upwardly and are positioned at two sides of the corresponding slope 223, each terminal receiving groove 22 further has a stopping face 225 which faces the rear end face 21 of the housing 2, the front end of the second oblique segment 322 of the positioning arm 32 pushes the positioning protrusions 131 of the corresponding conductive terminal 1 forwardly to the corresponding stopping face 225 so as to position the corresponding conductive terminal 1, because the angle of obliqueness of the second oblique segment 322 is larger than that of the first oblique segment 321, it can make the front end of the second oblique segment 322 push a lower side of the corresponding positioning protrusion 131, by which the conductive terminal 1 may be positioned better. And, the first oblique segment 321 with the smaller angle of obliqueness may play a role of avoiding the cable 4, in the first embodiment, the front end faces 411 of the insulating portions 41 of the cables 4 respectively abut the first oblique segments 321, thereby increasing the holding force to the cables 4, however in other varied embodiments, the front end faces 411 of the insulating portions 41 of the cables 4 also may not respectively abut the first oblique segments 321, and are not limited thereto. By the first oblique segment 321 with the smaller angle of obliqueness and the second oblique segment 322 with the larger angle of obliqueness, it can decrease the deformation amount of the positioning arm 32 of the holder 3 during inserting, so to decrease the force needed when inserting, and it can more effectively use the space of the housing 2 to avoid increasing a size of the electrical connector 10. In addition, referring to FIG. 6 and FIG. 10, the holder 3 further has a plurality of inward recessed faces 34 which are respectively formed to the positioning arms 32 and respectively face the conductive terminals 1, the inward recessed faces 34 respectively are arch surfaces which are recessed inwardly toward a direction away from the conductive terminals 1 and the conductive wire portions 42, and the inward recessed faces 34 extend respectively from the positioning arms 32 to the transverse frame portion 31, so to increase the holding force of the holder 3 to the conductive terminals 1 and the cables 4 and decrease the space occupied by the holder 3.

Referring to FIG. 1, FIG. 2, FIG. 6 and FIG. 8, the lock plate portion 33 is formed with a lock structure 331 which is locked with the locking structure 24 of the housing 2, when the lock structure 331 of the lock plate portion 33 and the locking structure 24 of the housing 2 are locked with each other, a front end face 311 of the transverse frame portion 31 of the holder 3 abuts the rear end face 21 of the housing 2, so as to make the holder 3 provided to the housing 2 more stably. In the first embodiment, a lock plate portion 33 of the holder 3 extends along the width direction D of the housing 2, the locking structure 24 of the housing 2 comprises two latch protruding blocks 241 which are spaced apart from each other along the width direction D of the housing 2, and the lock structure 331 of the lock plate portion 33 has two latch holes **331*a* which correspondingly latch with the latch protruding blocks 241 and are formed to penetrate the lock plate portion 33. It should be described that, in other embodiments, the latch holes 331*a* also may be blind holes instead of penetrating the lock plate portion 33, and the latch protruding block 241 and the latch hole 331*a* also each may be provided as one or three or more in number, and in a varied embodiment, the locking structure 24 of the housing 2 may also comprises the latch hole 331*a*, but the lock structure 331 of the lock plate portion 33 has the latch protruding block 241, that is to say, in the above embodiments, the lock structure 331 of the lock plate portion 33 and the locking structure 24 of the housing 2 are locked with each other in a concave convex fit, but furthermore, the locking structure 24 of the housing 2 and the lock structure 331 of the lock plate portion 33 also may be other existing structures which can be locked with each other instead of using a concave convex fit, and is not limited to the first embodiment. By the lock plate portion 33 which has elasticity, it prevents the lock plate portion 33 from limiting an angle at which the positioning arm 32 of the holder 3 is inserted into the terminal receiving groove 22 in a process that the holder 3 is assembled to the housing 2, and by the locking structure 24 of the housing 2 and the lock structure 331 of the lock plate portion 33 which are locked with each other in a concave convex fit, it can prevent the traveling path of the lock plate portion 33 from being limited in a process that the lock plate portion 33 is locked to the housing 2, so to further prevent the angle at which the positioning arm 32 of the holder 3 is inserted into the terminal receiving groove 22 from being limited. In addition, because the holder 3 is locked to the top surface 23 of the housing 2 by using the lock plate portion 33 which is connected to the transverse frame portion 31 and extends along the width direction D of the housing 2, when the holder 3 is applied to a case that the number of the conductive terminals 1 is large, the conductive terminal 1 positioned in the middle still can get enough holding force provided by the holder 3**.

Referring to FIG. 11 to FIG. 14, a second embodiment of the electrical connector 10 of the present disclosure is substantially the same as the first embodiment, however, in the second embodiment, the terminal receiving grooves 22 is a plurality of first terminal receiving grooves 22, the locking structure 24 is a first locking structure 24. The housing 2 further has a plurality of second terminal receiving grooves 22' which are arranged side by side along the width direction D of the housing 2, extend forwardly from the rear end face 21 of the housing 2 and are positioned below the first terminal receiving grooves 22 and a second locking structure 24' which is formed to a bottom surface 28 of the housing 2. In the second embodiment, the number of the conductive terminals 1 is double of that of the first embodiment, the first terminal receiving grooves 22 receive one part of the conductive terminals 1, the second terminal receiving groove 22' receive the other part of the conductive terminals 1 and the other part of the conductive terminals 1 are oriented in an upside down way. Each second terminal receiving groove 22' has a lower inner wall face 222', an upper inner wall face 221', a slope 223' which is formed to the lower inner wall face 222' and obliquely extends upwardly and forwardly from a position adjacent to the rear end face 21 of the housing 2, and a receiving recessed portion 224' which is formed to the upper inner wall face 221' and receives the corresponding conductive terminal 1, the electrical connector 10 further comprises another holder 3', positioning arms 32' of the holder 3' respectively obliquely extend upwardly and forwardly and are inserted into the second terminal receiving grooves 22', the lock plate portion 33' of the holder 3' extends forwardly to below the bottom surface 28 of the housing 2 and has elasticity, the corresponding slope 223' guides the positioning arm 32' to make a front end of the second oblique segment 322' position the corresponding conductive terminal 1, and the front end face 411 of the insulating portion 41 of the corresponding cable 4 is positioned at the first oblique segment 321', the lock structure 331' of the lock plate portion 33' is locked with the second locking structure 24'. Furthermore, in the second embodiment, the second terminal receiving grooves 22' and the first terminal receiving grooves 22 are configured in up-down mirror, the second locking structure 24' and the first locking structure 24 also are configured in up-down mirror, and the structures of the holder 3 and the holder 3' are the same as each other but only upside-down, so no more description will be given here, however, in a varied embodiment, there may still has some differences in a partial structure between the first terminal receiving grooves 22 and the second terminal receiving grooves 22', between the first locking structure 24 and the second locking structure 24', and between the holder 3 and the holder 3', and is not limited to the second embodiment.

In conclusion, in the electrical connector 10 of the present disclosure, by the lock plate portion 33 which has elasticity, it prevents the lock plate portion 33 from limiting an angle at which a positioning arm 32 of the holder 3 is inserted into the terminal receiving groove 22 in a process that the holder 3 is assembled to the housing 2, and by the first oblique segment 321 with a smaller angle of obliqueness and the second oblique segment 322 with a larger angle of obliqueness, it can decrease the deformation amount of positioning arm 32 of the holder 3 during inserting, so as to decrease the force needed when inserting, and can more effectively use the space of the housing 2 to avoid increasing the size of the electrical connector 10. In addition, because the holder 3 is locked to the top surface 23 of the housing 2 by the lock plate portion 33 which is connected to the transverse frame portion 31 and extends in the transverse direction, when the holder 3 is applied to a case that the number of the conductive terminals 1 is large, the conductive terminal 1 positioned in the middle still can get enough holding force provided by the holder 3.

However, the above description is only for the embodiments of the present disclosure, and the implementing scope of the present disclosure is not limited thereto, and all the simple equivalent changes and modifications according to the scope of the claims and the specification of the present disclosure are still fallen within the scope of the present disclosure.

The invention claimed is:

1. An electrical connector, comprising:

a plurality of conductive terminals, each conductive terminal connecting a cable mechanically, the cable comprising an insulating portion and a conductive wire portion, the insulating portion having a front end face, the conductive wire portion extending from the front end face and electrically connecting the conductive terminal;

a housing having a plurality of terminal receiving grooves which extend forwardly from a rear end face of the housing and receive the conductive terminals respectively and a locking structure which is formed to a top surface of the housing, each terminal receiving groove having an upper inner wall face, a lower inner wall face, a slope which is formed to the upper inner wall face and obliquely extends downwardly and forwardly from a position adjacent to the rear end face of the housing and a receiving recessed portion which is formed to the lower inner wall face and receives the corresponding conductive terminal; and a holder provided to the housing, the holder having a transverse frame portion which extends in a transverse direction, a plurality of positioning arms which obliquely extend downwardly and forwardly from the transverse frame portion and are respectively inserted into the terminal receiving grooves and a lock plate portion which extends forwardly from a top of the transverse frame portion to above a top surface of the housing and has elasticity, each positioning arm having a first oblique segment which is close to the transverse frame portion and a second oblique segment which is connected to the first oblique segment and is away from the transverse frame portion, an angle of obliqueness of the second oblique segment being larger than an angle of obliqueness of the first oblique segment, the corresponding slope guiding the positioning arm to make a front end of the second oblique segment position the corresponding conductive terminal, and the front end face of the insulating portion of the corresponding cable being positioned at the first oblique segment, the lock plate portion being formed with a lock structure which is locked with the locking structure of the housing.

2. The electrical connector according to claim 1, wherein the terminal receiving grooves are arranged side by side along a direction, the transverse frame portion extends along the direction.

3. The electrical connector according to claim 2, wherein the terminal receiving grooves are a plurality of first terminal receiving grooves, the locking structure is a first locking structure, the housing further has a plurality of second terminal receiving grooves which are arranged side by side along the direction, extend forwardly from the rear end face of the housing and are positioned below the first terminal receiving grooves and a second locking structure which is formed to a bottom surface of the housing, the first terminal receiving grooves receive one part of the conductive terminals, the second terminal receiving grooves receive the other part of the conductive terminals, each second terminal receiving groove has a lower inner wall face, an upper inner wall face, a slope which is formed to the lower inner wall face and obliquely extends upwardly and forwardly from a position adjacent to the rear end face of the housing and a receiving recessed portion which is formed to the upper inner wall face and receives the corresponding conductive terminal, the electrical connector further comprises another holder, the positioning arms of the another holder respectively obliquely extend upwardly and forwardly and are inserted into the second terminal receiving grooves respectively, a lock plate portion of the another holder extends forwardly to below a bottom surface of the housing and has elasticity, the corresponding slope of the second terminal receiving groove guides the positioning arm of the another holder to make a front end of a second oblique segment of the positioning arm of the another holder position the corresponding conductive terminal, and the front end face of the insulating portion of the corresponding cable is positioned at a first oblique segment of the positioning arm of the another holder, a lock structure of the another lock plate portion is locked with the second locking structure.

4. The electrical connector according to claim 1, wherein the lock structure of the lock plate portion and the locking structure of the housing are locked with each other in a concave convex fit.

5. The electrical connector according to claim 4, wherein the locking structure of the housing comprises at least one latch protruding block, the lock plate portion of the holder extends transversely, and the lock structure of the lock plate portion has at least one latch hole which is engaged with the at least one latch protruding block.

6. The electrical connector according to claim 5, wherein the at least one latch hole is formed to penetrate the lock plate portion.

7. The electrical connector according to claim 1, wherein the holder further has a plurality of inward recessed faces which are respectively formed to the positioning arms and respectively face the conductive terminals, the inward recessed faces respectively are arch surfaces which are recessed inwardly toward a direction away from the conductive terminals, and the inward recessed faces respectively extend from the positioning arms to the transverse frame portion.

8. The electrical connector according to claim 1, wherein each conductive terminal is formed with a positioning protrusion, each terminal receiving groove further has a stopping face, the front end of the second oblique segment of the positioning arm pushes the positioning protrusion of the corresponding conductive terminal forwardly to the corresponding stopping face to position the corresponding conductive terminal.

9. The electrical connector according to claim 1, wherein a front end face of the transverse frame portion of the holder abuts the rear end face of the housing.

10. The electrical connector according to claim 1, wherein the front end faces of the insulating portions of the cables respectively abut the first oblique segments.

11. The electrical connector according to claim 1, wherein each conductive terminal has a first clamping portion which clamps the insulating portion of the corresponding cable and a second clamping portion which clamps the conductive wire portion of the cable to be electrically connect with the conductive wire portion.

* * * * *